US007083887B2

(12) United States Patent
Nakamura et al.

(10) Patent No.: US 7,083,887 B2
(45) Date of Patent: Aug. 1, 2006

(54) COLOR TONER AND IMAGE FORMING APPARATUS USING THE COLOR TONER

(75) Inventors: Yasushige Nakamura, Kanagawa (JP); Yoshimichi Katagiri, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 196 days.

(21) Appl. No.: 10/681,241

(22) Filed: Oct. 9, 2003

(65) Prior Publication Data

US 2004/0142262 A1 Jul. 22, 2004

(30) Foreign Application Priority Data

Oct. 16, 2002 (JP) ..... P.2002-302005

(51) Int. Cl.
*G03G 9/09* (2006.01)

(52) U.S. Cl. ..... 430/107.1; 430/108.21; 430/108.24; 399/223

(58) Field of Classification Search ..... 430/107.1, 430/108.21, 108.24; 399/223
See application file for complete search history.

(56) References Cited

U.S. PATENT DOCUMENTS 4,539,284 A * 9/1985 Barbetta et al. ..... 430/108.23
5,719,002 A * 2/1998 Ciccarelli et al. ..... 430/137.1
2003/0186148 A1* 10/2003 Nakamura et al. ..... 430/107.1

FOREIGN PATENT DOCUMENTS

| | | |
|---|---|---|
| JP | A 61-132959 | 6/1986 |
| JP | A 6-118694 | 4/1994 |
| JP | A 7-191492 | 7/1995 |
| JP | A 10-39535 | 2/1998 |
| JP | A 11-38666 | 2/1999 |
| JP | A 2002-156779 | 5/2002 |

* cited by examiner

*Primary Examiner*—Mark A. Chapman
(74) *Attorney, Agent, or Firm*—Oliff & Berridge, PLC

(57) ABSTRACT

This invention provides: a color toner to be fixed on a recording medium with a flash light comprising a binder resin, an infrared ray absorbent and a coloring agent for mainly developing a yellow color, wherein the coloring agent is C.I. Pigment Yellow 180 or C.I. Pigment Yellow 185; a color toner to be fixed on a recording medium with a flash light comprising a binder resin, an infrared ray absorbent and a coloring agent for mainly developing a magenta color, wherein the coloring agent is C.I. Pigment Violet 19; and a color toner to be fixed on a recording medium with a flash light comprising a binder resin, an infrared ray absorbent and a coloring agent for mainly developing a cyan color, wherein the coloring agent is C.I. Pigment Blue 15. Also disclosed are a color toner set comprising these color toners and an image forming apparatus employing at least one of the color toners or the color toner set.

15 Claims, 4 Drawing Sheets

COLOR TONER AND IMAGE FORMING APPARATUS USING THE COLOR TONER

FIELD OF THE INVENTION

The present invention relates to a color toner used in an electrophotographic method, and particularly to a color toner to be fixed on a recording medium using optical energy given by a flash light.

BACKGROUND OF THE INVENTION

The electrophotographic method is a technique widely used in image forming apparatus such as an electrophotographic facsimile and an electrophotographic printer. As the electrophotographic method, a system using a photoconductive insulator is generally used. In this system, a toner image is once formed on the photoconductive insulator by using a toner, a resin powder colored with a pigment or a dye, and transferred onto a recording medium such as paper. Then, the toner is fused on the recording medium by heat, pressure or light, followed by solidification to finally obtain a toner image fixed onto the recording medium. This fixing system is roughly divided into a heat roll fixing system and a flash fixing system.

In recent years, the market for on-demand printing has rapidly expanded. In the on-demand printing, it is necessary to prepare hundreds to thousands of printed materials for a sort delivery period according to the diversifying needs of customers. For such a purpose, the electrophotographic printer capable of conducting high-speed printing is suitable.

When the fixing system is studied from the viewpoint of speeding up of printing speed in order to satisfy such needs, the heat roll fixing system has a limitation on the speeding up, because a recording medium, for example, paper, on which a toner image is formed, is pressed with a heating roll to cause the liability of the paper to crinkle, resulting in the occurrence of paper clogging. Further, the toner is partly transferred to the heating roll in fixing, so that it becomes necessary to periodically clean the heating roll.

On the other hand, in the flash fixing system, optical energy given by a flash light of a discharge tube such as a xenon flash lamp is converted into thermal energy, thereby fusing a toner and fixing it onto a recording medium. Accordingly, this system has the advantage that the speeding up is easy because high-speed and non-contact fixing of the toner is possible.

In the spectral distribution of the xenon lamp generally used as the discharge tube for flash fixing, the light emission intensity in a near-infrared wavelength region of 800 nm to 1,000 nm is significantly high, and the light emission intensity in a visible region of 400 nm to 800 nm is relatively low. It is therefore required that the toner subjected to flash fixing has high optical absorption in the near-infrared wavelength region.

However, coloring agents added to color toners generally have low optical absorption in the near-infrared wavelength region. Consequently, in order to improve optical absorption to improve fixability, an infrared ray absorbent is added to the toner. As the infrared ray absorbents for the toner, there are known an aminium salt, a diimonium compound, a cyanine compound, a nickel complex compound, a phthalocyanine compound, an ytterbium oxide compound, etc. (See, for example, JP-A-61-132959 (the term "JP-A" as used herein means an "unexamined published Japanese patent application"), JP-A-7-191492, JP-A-10-39535, and JP-A-11-038666). Further, a technique of adhering the infrared ray absorbent to the surface of the toner has been proposed (See JP-A-2002-156779 and JP-A-06-118694).

Patent Document 1: JP-A-2002-156779

Patent Document 2: JP-A-11-038666

Patent Document 3: JP-A-06-118694

However, the infrared ray absorbent has absorption also in the wavelength region of a red color, so that it develops a green color which is a complementary color to the red color. Accordingly, when the same pigment as contained in the infrared ray absorbent-free toner of the heat roll system is used in the toner to be subjected to flash fixing, the whole color gamut is shifted by the influence of the color of the infrared ray absorbent. The as-shifted color gamut cannot provide sufficient color reproducibility, even when adjustment is carried out with an image forming apparatus such as an electrophotographic printer. For example, the use of a green infrared ray absorbent such as naphthalocyanine raises the problem that a red color is darkened, resulting in failure to obtain a bright red color. Furthermore, the red color is a color most frequently used, so that the problem is encountered that the whole color reproducibility is impaired.

SUMMARY OF THE INVENTION

The invention has been made in view of the above-mentioned problems.

Accordingly, an object of the invention is to provide a color toner for flash fixing which is good in the whole color reproducibility and has a wide color reproduction range.

Another object of the invention is to provide a color toner set comprising the color toner.

A still other object of the invention is to provide an image forming apparatus using the color toner or color toner set.

Other objects and effects of the invention will become apparent from the following description.

According to one aspect of the invention, there is provided a color toner to be fixed on a recording medium with a flash light, comprising a binder resin, an infrared ray absorbent and a coloring agent for mainly developing a yellow color, wherein the coloring agent is C.I. Pigment Yellow 180 or C.I. Pigment Yellow 185.

C.I. Pigment Yellow 180 as used herein is a benzimidazolone-based pigment represented by the following formula (2):

(2)

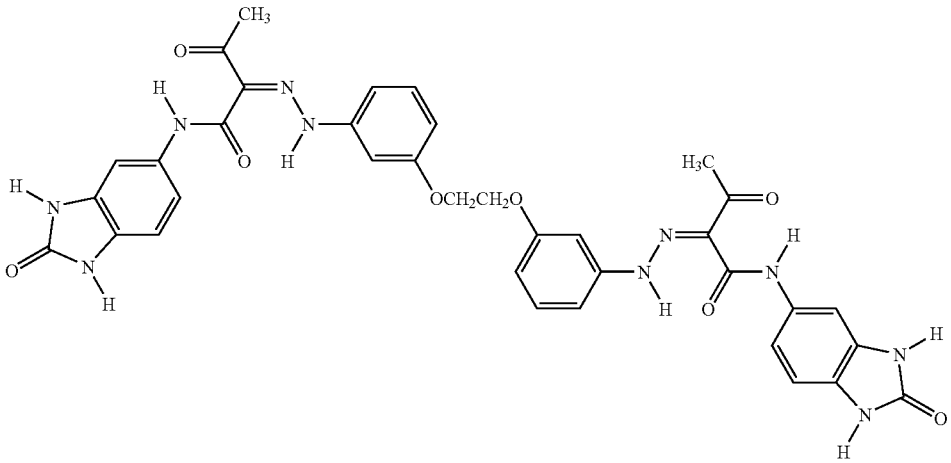

Further, C.I. Pigment Yellow 185 is an isoindoline-based pigment represented by the following formula (3):

(3)

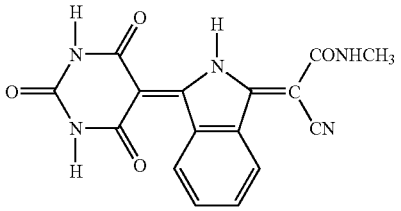

According to this aspect of the invention, the color toner of the invention comprises an infrared ray absorbent. The infrared ray absorbent has an absorption peak in a near-infrared region and has an absorption peak in a red region, so that it develops a green color. On the other hand, the color toner of this aspect of the invention comprises C.I. Pigment Yellow 180 or C.I. Pigment Yellow 185. These yellow coloring agents can compensate for the green color of the infrared ray absorbent, because of their high opacifying properties and pigment coloring amount. As a result, the color toner of the invention can provide a hue which is little different, compared to an infrared ray absorbent-free yellow toner for the heat roll fixing system.

According to another aspect of the invention, there is provided a color toner to be fixed on a recording medium with a flash light comprising a binder resin, an infrared ray absorbent and a coloring agent for mainly developing a magenta color, wherein the coloring agent is C.I. Pigment Violet 19.

C.I. Pigment Violet 19 as used herein is a quinacridone represented by the following formula (4):

(4)

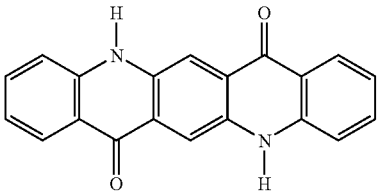

According to this aspect of the invention, the color toner of the invention comprises an infrared ray absorbent. As described above, the infrared ray absorbent generally develops a green color. On the other hand, the color toner of the invention comprises C.I. Pigment Violet 19. This coloring agent can compensate for the influence of the green color of the infrared ray absorbent, because of its high pigment coloring amount. As a result, a magenta toner which is good in color reproducibility and has a wide color reproduction range can be obtained, and this magenta toner can provide a hue which is little different, compared to an infrared ray absorbent-free magenta toner for the heat roll fixing system.

According to still another aspect of the invention, there is provided a color toner to be fixed on a recording medium with a flash light comprising a binder resin, an infrared ray absorbent and a coloring agent for mainly developing a cyan color, wherein the coloring agent is C.I. Pigment Blue 15.

C.I. Pigment Blue 15 as used herein is α-type copper phthalocyanine represented by the following formula (5):

(5)

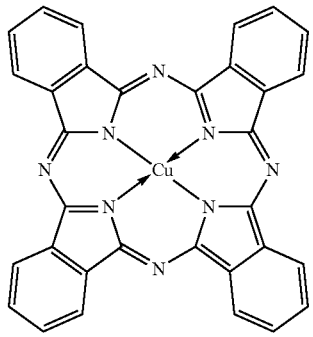

According to this aspect of the invention, the color toner of the invention comprises an infrared ray absorbent. As described above, the infrared ray absorbent generally develops a green color. On the other hand, the color toner of the invention comprises C.I. Pigment Blue 15. This coloring agent can compensate for the green color of the infrared ray absorbent, because it gives a reddish blue color. As a result, a cyan toner good in color reproducibility can be obtained.

According to a further aspect of the invention, there is provided a color toner set forming a multi-color image through fixing on a recording medium with a flash light, which comprises at least a yellow toner, a magenta toner and a cyan toner, wherein each toner comprises a binder resin, an infrared ray absorbent and a coloring agent, and wherein the coloring agent of the yellow toner comprises C.I. Pigment Yellow 180 or C.I. Pigment Yellow 185, the coloring agent of the magenta toner comprises C.I. Pigment Violet 19, and the coloring agent of the cyan toner comprises C.I. Pigment Blue 15.

According to this aspect of the invention, the color toners of the invention each comprise an infrared ray absorbent. Further, as the coloring agents, the yellow toner comprises C.I. Pigment Yellow 180 or C.I. Pigment Yellow 185, the magenta toner comprises C.I. Pigment Violet 19, and the cyan toner comprises C.I. Pigment Blue 15. As described above, these coloring agents can compensate for the green color of the infrared ray absorbent. As a result, color toners which are good in the whole color reproducibility and have a wide color reproduction range can be obtained. The color reproducibility of the toners comes closer to that of the color toner for the heat roll fixing system, so that it is possible to use the same color matching system as with the color toner for the heat roll fixing system.

The amounts of the coloring agents contained in the color toners may satisfy the following relationship:

$$Qm>Qy>Qc$$

wherein Qm, Qy and Qc represent the amounts of the coloring agents contained in the magenta, yellow and cyan toners, respectively, each based on 100 parts by weight of the respective color toner. Further, the above-mentioned magenta toner may comprise C.I. Pigment Violet 19 in an amount of more than 4 to 20 parts by weight based on 100 parts by weight of the toner. The above-mentioned cyan toner may comprise C.I. Pigment Blue 15 in an amount of 5 parts by weight or less based on 100 parts by weight of the toner.

Further, the above-mentioned infrared ray absorbent may comprise a naphthalocyanine compound represented by the following general formula (1):

(1)

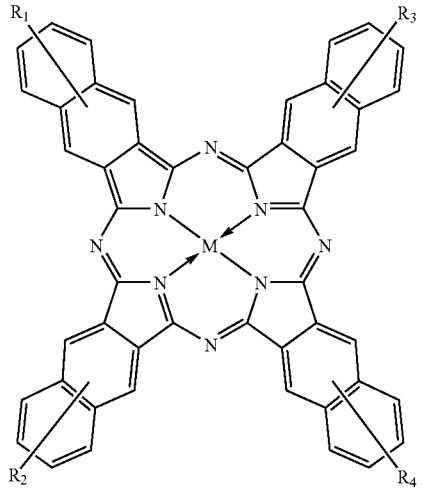

wherein M represents a metal, a metal oxide or a metal halide, R1 to R4 each represents a hydrogen atom, a halogen atom, an alkyl group, an aryl group, an alkoxyl group, a nitro group or a carboxyl group.

Furthermore, the above-mentioned binder resin may have a number average molecular weight of 1,000 to 2,500.

According to a still further aspect of the invention, there is provided an image forming apparatus for superposing at least a yellow toner, a magenta toner and a cyan toner one on another to form a multi-color image and fixing the toners on a recording medium with a flash light, which apparatus employs any one or more of the above-mentioned color toners or the color toner set.

According to this aspect of the invention, the use of the above-mentioned color toner or color toner set makes it possible to form an image which is good in the whole color reproducibility and has a wide color reproduction range.

Figure 1:
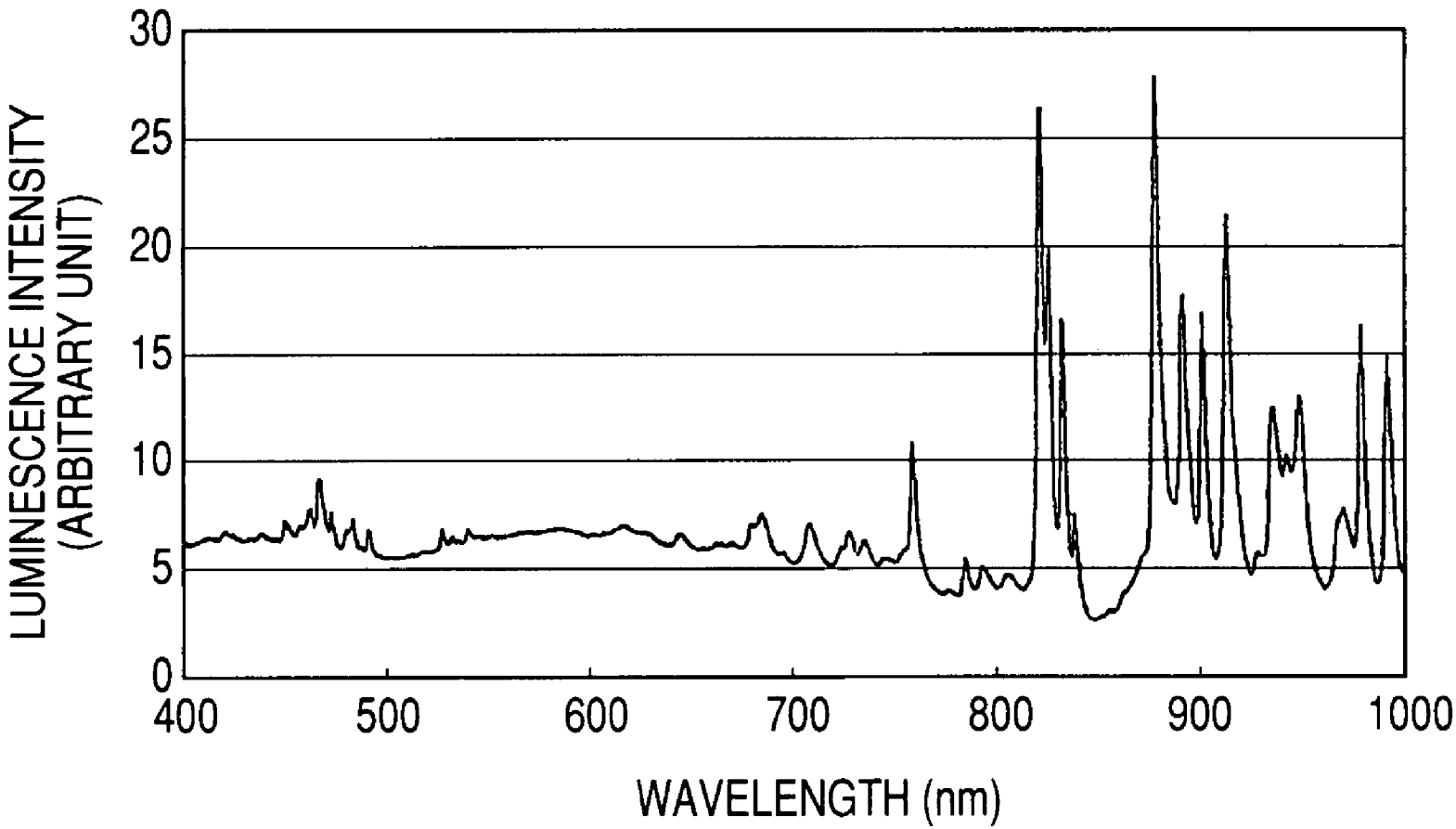
FIG. 1 is a graph showing a spectral distribution of a xenon flash lamp.

The reference numerals used in the drawings represents the followings, respectively.

10: Image forming apparatus
11: Image reading/processing unit
12: Image write unit
13Y, 13M, 13C, 13K: Developing units
14: Photoreceptor
16: Primary transfer unit
18: Intermediate transfer body
19: Secondary transfer unit
20: Xenon flash lamp
21: Flash fixing device
22: Photoreceptor cleaning unit

DETAILED DESCRIPTION OF THE INVENTION

The color toner for flash fixing of the invention will be described in detail below.

The color toner for flash fixing of the invention comprises at least a binder resin, an infrared ray absorbent and a coloring agent.

The above-mentioned infrared ray absorbent has a function of converting optical energy of a flash light into thermal energy in a fixing unit of an image forming apparatus. This infrared ray absorbent is added in order to accelerate fusion of the binder resin.

In order to efficiently absorb a flash light, the infrared ray absorbent has at least one intensive optical absorption peak in a near-infrared region having an optical wavelength of 750 nm to 2,000 nm. As the infrared ray absorbent of the invention, there can be used either an organic material or an inorganic material. Examples of the infrared ray absorbents usable herein include an aluminum compound, a diimonium compound, a naphthalocycnine compound, a phthalocyanine compound, a nickel complex compound and an ytterbium oxide compound. In particular, the naphthalocyanine compound represented by the above-mentioned general formula (1) is preferred, because it efficiently converts optical energy of a flash light into thermal energy, thereby contributing to improvement of fixability.

The infrared ray absorbent is generally added in an amount of 0.01 to 15 parts by weight, and preferably in an amount of 0.1 to 5 parts by weight, based on 100 parts by weight of the toner. More than 15 parts by weight results in a large change in the color of the toner, whereas less than 0.1 part by weight results in failure to fuse the binder resin, because optical energy of a flash light can not be sufficiently absorbed to cause insufficient quantity of heat.

The infrared ray absorbent may be treated with a coupling agent, etc. The coupling agent improves the dispersibility of the infrared ray absorbent, which allows desired optical energy to be obtained by using the infrared ray absorbent in a smaller amount. As a result, the shift of the color gamut caused by color development of the infrared ray absorbent can be decreased. The coupling agent is preferably a silane coupling agent, an aluminum coupling agent or a titanium coupling agent, in regard to a higher degree of improvement in the dispersibility of the infrared ray absorbent. The amount of the coupling agent is generally from 0.01 to 20 parts by weight, preferably from 0.05 to 10 parts by weight, and more preferably from 0.1 to 5 parts by weight, based on 100 parts by weight of the infrared ray absorbent. The coupling treatment is carried out by dry mixing or the like.

The infrared ray absorbent is colored light green to dark green according to its absorption wavelength characteristics, so that selection of the coloring agent is important for the use of such a infrared ray absorbent.

As the coloring agent for the yellow toner of the invention, there is used benzimidazolone or C.I. Pigment Yellow 185. These coloring agents have high opacifying properties and pigment coloring amount, so that the yellow toner of the invention can provide a hue which is little different, compared to an infrared ray absorbent-free yellow toner for the heat roll fixing system.

C.I. Pigment Violet 19 is used as the coloring agent for the magenta toner. This coloring agent has a high pigment coloring amount, so that the color gamut is difficult to vary, compared to the case where a monoazo pigment or Naphthol Carmine F68 is used, which is frequently used in the heat roll fixing system.

C.I. Pigment Blue 15 is used as the coloring agent for the cyan toner. C.I. Pigment Blue 15 can compensate for the green color of the infrared ray absorbent to obtain the good color gamut, because it has a reddish blue color.

The coloring agent is generally added in an amount of 0.1 to 20 parts by weight (preferably 0.5 to 15 parts by weight) based on 100 parts by weight of the toner. Exceeding 20 parts by weight results in a dark color. Further, it is preferred that the ratios of the addition amounts of the coloring agents for the respective toners to the weights of the toners satisfy the following relationship:

$$Qm>Qy>Qc$$

wherein Qm, Qy and Qc represent the amounts of the coloring agents contained in the magenta, yellow and cyan toners, respectively, each based on 100 parts by weight of the respective color toner. Magenta is a complementary color to the green color of the infrared ray absorbent. It is therefore necessary to add the coloring agent for the magenta toner in the largest amount, thereby compensating for the color gamut shifted to the green color. The coloring agent for the magenta toner is preferably contained in an amount of 5 parts by weight or more based on 100 parts by weight of the magenta toner. Yellow is a plain color, so that it is liable to be influenced by the green color of the infrared ray absorbent, next to magenta. Cyan is most hardly influenced by the green color, so that only a relatively small amount of the coloring agent for the cyan toner is required. On the other hand, for the cyan toner, when paper sheets are rubbed together, stains are liable to occur on the paper sheets. Accordingly, the coloring agent for the cyan toner is preferably added in an amount of 6 parts by weight or less.

As the binder resins contained in the color toners of the invention, various thermoplastic resins can be used. For example, a styrene-acrylic resin, an epoxy resin, a polyester polyol resin, a polylactic acid resin, a polyester resin, etc. can be used. However, in terms of less odors generated upon fixing and excellent fusing characteristics upon irradiation of a flash light, a polyester is preferred. Further, different from the toner used in the heat roll fixing system, the binder resin is not required to impart release properties. Accordingly, it is preferred that the binder resin has a number average molecular weight of 1,000 to 2,500 in terms of easy occurrence of viscous flow. Less than 1,000 results in sublimation of the binder resin, leading to clogging of a flue gas filter for odor elimination. On the other hand, 2,500 or more results in difficulty of fusing, which causes poor fixability and deteriorated color development.

In addition to the binder resin, a general-purpose wax such as polyethylene, polypropylene, ester wax, Carunauba wax, Fisher-Tropsch wax, paraffin wax or rice wax can be used in combination as an auxiliary binder.

As described above, the toner of the invention contains, for example, the binder resin in an amount of 65 to 97 parts by weight, the coloring agent in an amount of 0.1 to 20 parts by weight (preferably 0.5 to 15 parts by weight), the infrared ray absorbent in an amount of 0.01 to 15 parts by weight (preferably 0.1 to 5 parts by weight) and the auxiliary binder in an amount of 0 to 5 parts by weight.

Further, a charge controlling agent may be added to the color toner of the invention in order to decrease the change in the charged amount upon imparting the electrostatic property or under circumstances different in temperature and humidity. The charge controlling agent is preferably a colorless or pale-colored one. As the charge controlling agent, there can be used, for example, a known positive or negative charge controlling agent such as calixarene, a nigrosin dye, a quaternary ammonium salt, an amino group-containing polymer, a metal-containing azo dye, a complex compound of salicylic acid, a phenol compound, an azochromium compound or an azo zinc compound.

Further, in order to improve the fluidity of the color toner of the invention, fine white inorganic particles can also be added and mixed as a fluidity improving agent. Such fine white inorganic particles include, for example, finely divided particles of silica, alumina, titanium oxide, barium titanate, magnesium titanate, calcium titanate, strontium titanate, zinc oxide, quartz sand, clay, mica, wallastonite, diatomaceous earth, chromium oxide, cerium oxide, red iron oxide, antimony trioxide, magnesium oxide, zirconium oxide, barium sulfate, barium carbonate, calcium carbonate, silicon carbide, silicon nitride, etc. Of these, fine silica particles are particularly preferably used. These fine inorganic particles may be used as a combination of two or more of them. The amount thereof added is from 0.01 to 5 parts by weight, and preferably from 0.01 to 2 parts by weight, based on 100 parts by weight of the toner.

Further, fine particles of compounds such as a metal salt of a higher fatty acid represented by zinc stearate, a fluoropolymer or an acrylic resin may be added to the color toner of the invention as a cleaning active agent. Furthermore, a magnetic material such as iron powder, magnetite or ferrite can also be added and used as a magnetic toner.

The color toner of the invention can be produced by a known method. At least, the binder resin, the infrared ray absorbent and the coloring agent are prepared, and the charge controlling agent and the wax are further added thereto as needed to form a raw material. This raw material is kneaded and uniformly dispersed, for example, by use of a Henschel mixer, a pressure kneader, a roll mill, a ball mill or an extruder. Then, it is pulverized to a fine powder with a pulverizer or a jet mill, and classified with a pneumatic classifying apparatus or the like to obtain the color toner having a desired particle size. In kneading, a method may be used in which the infrared ray absorbent and the charge controlling agent are separately kneaded with different resins, and both of the resulting resins are kneaded with each other again.

EXAMPLES

The present invention will be illustrated in greater detail with reference to the following Examples and Comparative Examples, but the invention should not be construed as being limited thereto.

Production of Color Toners

Table 1 shows coloring agents (yellow) used in the production of color toners, Table 2(A) shows coloring agents (magenta) used in the production of color toners, and Table 2(B) shows coloring agents (cyan) used in the production of color toners. Tables 3 to 5 show formulations of color toners used in Examples according to the invention and Comparative Examples not according to the invention, and show the formulations of yellow toners, magenta toners and cyan toners in this order.

TABLE 2(A)

Coloring Agents (for Magenta Toners) Used in Production of Color Toners

| | Sample Name | | | |
|---|---|---|---|---|
| | MG-1 | MG-2 | MG-3 | MG-4 |
| Material | Quinacridone | Dimethyl-quinacridone | Naphthol pigment | Rhodamine |
| C.I. Pig. | Violet 19 | Red 122 | Red 184 | |
| Product Name | Hostaperm Red E2B70 | Hostaperm Pink E02 | Permanent Rubine F6B | D4830 |
| Manufacturer | Clariant | Clariant | Clariant | BASF |

TABLE 2(B)

Coloring Agents (for Cyan Toners) Used in Production of Color Toners

| | Sample Name | | |
|---|---|---|---|
| | CG-1 | CG-2 | CG-3 |
| Material | α-Type copper phthalocyanine | β-Type copper phthalocyanine | ε-Type copper phthalocyanine |
| C.I. Pig. | Blue 15 | Blue 15:3 | Blue 15:6 |
| Product Name | BLPO | B2G | D6700 |
| Manufacturer | Ciba Geigy | Clariant | BASF |

TABLE 1

Coloring Agents (for Yellow Toners) Used in the Production of Color Toners

| | Sample Name | | | | | | |
|---|---|---|---|---|---|---|---|
| | YG-1 | YG-2 | YG-3 | YG-4 | YG-5 | YG-6 | YG-7 |
| Compound Name | Benzimidazolone | Isoindoline-based pigment | Bisacetallylide | Azo pigment | Anthraquinone | Benzimidazolone-based monoazo pigment | Benzimidazolone-based pigment |
| C.I. Pig. | Yellow 180 | Yellow 185 | Yellow 155 | Yellow 62 | Yellow 147 | Yellow 151 | Yellow 154 |
| Product Name | Novoperm Yellow P-HG | D1155 | Toner Yellow 3GP | WSR | Y-RNB | 4GO | Fast Yellow 4192 |
| Manufacturer | Clariant | BASF | Clariant | Ciba Geigy | Ciba Geigy | Dainippon Ink | Dainippon Ink |

TABLE 3

Formulations of Yellow Toners Used in Examples According to the Invention and Comparative Examples Not According to the Invention

| | Sample Name | YT-1 | YT-2 | YT-3 | YT-4 | YT-5 | YT-6 | YT-7 | Reference Example |
|---|---|---|---|---|---|---|---|---|---|
| Coloring Agent | YG-1 | 5.0 | | | | | | | |
| | YG-2 | | 5.0 | | | | | | |
| | YG-3 | | | 5.0 | | | | | |
| | YG-4 | | | | 5.0 | | | | |
| | YG-5 | | | | | 5.0 | | | |
| | YG-6 | | | | | | 5.0 | | |
| | YG-7 | | | | | | | 5.0 | |
| Binder resin | S-0 | 92.5 | 92.5 | 92.5 | 92.5 | 92.5 | 92.5 | 92.5 | |
| Charge Controlling Agent | N4P (Clariant) | 1.0 | 1.0 | 1.0 | 1.0 | 1.0 | 1.0 | 1.0 | |
| Infrared Ray Absorbent | YKR-5010 (Yamamoto Kasei) | 1.0 | 1.0 | 1.0 | 1.0 | 1.0 | 1.0 | 1.0 | |
| Wax | NP-105 (Mitsui Chemicals) | 0.5 | 0.5 | 0.5 | 0.5 | 0.5 | 0.5 | 0.5 | |
| Color Tone | a* | −10.3 | −12.2 | −13.3 | 10.2 | −6.3 | −12.3 | −11.2 | −11.3 |
| | b* | 75.4 | 70.6 | 58.4 | 59.4 | 61.2 | 60.2 | 62.3 | 79.3 |
| | $\{(a^*)^2 + (b^*)^2\}^{1/2}$ | 78.07 | 71.6 | 59.8 | 60.2 | 61.5 | 61.4 | 63.3 | 80.1 |
| | L* | 85.5 | 85.3 | 80.1 | 83.6 | 83.1 | 83.1 | 82.1 | 90.9 |
| | ΔE | 6.7 | 10.4 | 23.6 | 21.3 | 20.3 | 20.7 | 19.1 | |
| Smearing Property | | Good | Good | Good | Good | Good | Good | Good | |
| Overall Evaluation | | Good | Good | Poor | Poor | Poor | Poor | Poor | |

TABLE 4

Formulations of Magenta Toners Used in Examples According to the Invention and Comparative Examples Not According to the Invention

| | Sample Name | MT-1 | MT-2 | MT-3 | MT-4 | MT-5 | Reference Example |
|---|---|---|---|---|---|---|---|
| Coloring Agent | MG-1 | 8.0 | | | | 4.0 | |
| | MG-2 | | 8.0 | | | | |
| | MG-3 | | | 8.0 | | | |
| | MG-4 | | | | 8.0 | | |
| Binder resin | S-0 | 89.5 | 89.5 | 89.5 | 89.5 | 93.5 | |
| Charge Controlling Agent | N4P (Clariant) | 1.0 | 1.0 | 1.0 | 1.0 | 1.0 | |
| Infrared Ray Absorbent | YKR-5010 (Yamamoto Kasei) | 1.0 | 1.0 | 1.0 | 1.0 | 1.0 | |
| Wax | NP-105 (Mitsui Chemicals) | 0.5 | 0.5 | 0.5 | 0.5 | 0.5 | |
| Color Tone | a* | 55.8 | 50.6 | 43.3 | 44.2 | 46.2 | 63.5 |
| | b* | 3.2 | −8.2 | 3.0 | −2.6 | 3.1 | −2.6 |
| | $\{(a^*)^2 + (b^*)^2\}^{1/2}$ | 55.9 | 51.3 | 43.4 | 44.3 | 46.3 | 63.6 |
| | L* | 51.9 | 51.9 | 46.0 | 46.0 | 55.1 | 55.2 |
| | ΔE | 10.2 | 14.5 | 22.9 | 21.4 | 18.2 | |
| Smearing Property | | Good | Good | Good | Good | Good | |
| Overall Evaluation | | Good | Poor | Poor | Poor | Poor | |

TABLE 5

Formulations of Cyan Toners Used in Examples According to the Invention and Comparative Examples Not According to the Invention

| | Sample Name | CT-1 | CT-2 | CT-3 | CT-4 | CT-5 | Reference Example |
|---|---|---|---|---|---|---|---|
| Coloring Agent | CG-1 | 3.0 | | | 5.0 | 7.0 | |
| | CG-2 | | 3.0 | | | | |
| | CG-3 | | | 3.0 | | | |
| Binder resin | S-0 | 94.5 | 94.5 | 94.5 | 92.5 | 90.5 | |
| Charge Controlling Agent | N4P (Clariant) | 1.0 | 1.0 | 1.0 | 1.0 | 1.0 | |
| Infrared Ray Absorbent | YKR-5010 (Yamamoto Kasei) | 1.0 | 1.0 | 1.0 | 1.0 | 1.0 | |
| Wax | NP-105 (Mitsui Chemicals) | 0.5 | 0.5 | 0.5 | 0.5 | 0.5 | |
| Color Tone | a* | −14 | −27.6 | −10.2 | −15.3 | −15.6 | −17.6 |
| | b* | −35.2 | −30.5 | −26.3 | −33.7 | −32.4 | −47.5 |
| | $\{(a^*)^2 + (b^*)^2\}^{1/2}$ | 37.9 | 41.1 | 28.2 | 37.0 | 36.0 | 50.7 |
| | L* | 49.8 | 46.3 | 48.3 | 44.1 | 38.6 | 58.5 |
| | ΔE | 15.5 | 23.2 | 24.7 | 20.1 | 25.1 | |
| Smearing Property | | Good | Good | Good | Good | Poor | |
| Overall Evaluation | | Good | Poor | Poor | Poor | Poor | |

Using the coloring agents shown in Tables 1, 2(A) and 2(B), the color toners shown in Tables 3 to 5 were produced which were used in Examples as color toners of the invention and in Comparative Examples as color toners not according to the invention. Further, in Comparative Example MT-5 shown in Table 4 and Example CT-4 and Comparative Example CT-5 shown in Table 5, color toners varied in the addition amount of the coloring agent were produced.

In each color toner, common materials were used as a binder resin, an infrared ray absorbent, a charge controlling agent and a wax. Specifically, a polyester (number average molecular weight: 1526, weight average molecular weight: 9980) was used as the binder resin, YKR-5010 (trade name, Yamamoto Kasei Co., Ltd.) of a naphthalocyanine compound as the infrared ray absorbent, and N4P (trade name, Clariant Corp.) as the charge controlling agent, and NP-105 (trade name, Mitsui Chemicals, Inc.) as the wax.

Based on the formulations shown in Tables 3 to 5, these materials were supplied into a Henschel mixer, and preliminarily kneaded at 600 rpm for 10 minutes, followed by kneading by means of an extruder. As for conditions in that case, the number of revolutions was set to 200 rpm, the throughput flow to 20 kg/hour, and the temperature to 150° C. Then, the resulting product was roughly pulverized with a hammer mill, finely pulverized with a jet mill, and classified with a pneumatic classifying apparatus to obtain fine colored particles having a volume average particle size of 8.5 μm. Then, 1.5 parts by weight of R974 (trade name, manufactured by Nippon Aerosil Co., Ltd.), fine hydrophobic silica particles, was added, and external addition treatment was conducted with a Henschel mixer to obtain each of the color toners of Examples and Comparative Examples shown in Tables 3 to 5.

Evaluations of Color Reproducibility and Smearing Property

For each of the color toners of Examples and Comparative Examples shown in Tables 3 to 5, a toner image was formed on a recording medium by use of a flash fixing type printer, and the color reproducibility and smearing property thereof were evaluated.

A converted printer was used in which a flash fixing unit of a PS2160 flash printer (manufactured by Fujitsu Corporation) was mounted on a GL8300 laser printer (manufactured by Fujitsu Corporation) using a monocomponent developing agent. A flash lamp of this flash fixing unit had a spectral distribution shown in FIG. 1, and the optical energy per unit area of the recording medium (paper) was 3.2 J/cm$^2$.

For the fixed image thus obtained, the color reproducibility (color values) was evaluated. The reproducibility was evaluated by measuring L*, a* and b* of CIE of the fixed image. Specifically, measurements were made using a color difference meter, a 938 spectrodensitometer (measurement light source: CIE-D65) manufactured by X-Rite, Inc., based on ISO/CD13655.

Further, for the fixed image, the smearing property was evaluated. The smearing property was evaluated by rubbing the fixed image with a white paper sheet, and measuring smears of the white paper sheet by use of the above-mentioned color difference meter, the 938 spectrodensitometer. The case where the color difference (ΔE) between a smeared portion the white paper sheet and a portion not rubbed of the white paper sheet was less than 2 was judged as "good", and the case where ΔE was 2 or more was judged as "poor".

First, for each of the yellow toners, the magenta toners and the cyan toners, results of the evaluation of the color reproducibility are shown in Tables 3 to 5. In Tables 3 to 5, L, a* and b* of a fixed image printed using a GL8300 laser printer of the heat roll fixing system (manufactured by Fujitsu Corporation) and a genuine color toner for this laser printer at an amount of the color toner deposited on a paper sheet of 0.6 mg/cm$^2$ are shown as Reference Example.

In Table 3, preferred toners can be confirmed for the yellow toners. In YT-1 containing the coloring agent of C.I. Pigment Yellow 180 (YG-1) and YT-2 containing the coloring agent of C.I. Pigment Yellow 185 (YG-2), $\sqrt{\{(a^*)^2+(b^*)^2\}}$ obtained by using a* and b* indicating color tones is as large as 70 or more, compared to those of YT-3 to YT-7. This reveals that the color gamut is wider, because $\sqrt{\{(a^*)^2+(b^*)^2\}}$ shows color saturation.

Further, calculation of the color difference (ΔE) between each yellow toner and the yellow toner of Reference Example indicates that YT-1 and YT-2 are small in ΔE, compared to YT-3 to YT-7, and close to the yellow toner of the heat roll fixing system, that is to say, compensate for the influence of the green color of the infrared ray absorbent. As for the smearing property, all yellow toners had no problem. The color difference (ΔE) between each yellow toner and the yellow toner of Reference Example is represented by the following equation:

$$\Delta E=\sqrt{\{(L^*-L^*_{REF})^2+(a^*-a^*_{REF})^2+(b^*-b^*_{REF})^2\}}$$

wherein L*, a* and b* each represents a value of each yellow toner, and $L^*_{REF}$, $a^*_{REF}$ and $b^*_{REF}$ each represents a value of the yellow toner of Reference Example.

Accordingly, YT-1 and YT-2, that is to say, the yellow toner containing the coloring agent of C.I. Pigment Yellow 180 and the yellow toner containing the coloring agent of C.I. Pigment Yellow 185, can compensate for the influence of the green color of the infrared ray absorbent, so that the yellow toners which are good in color reproducibility and wide in the color reproduction range can be obtained.

In Table 4, a preferred toner can be confirmed for the magenta toners. MT-1 containing the coloring agent of C.I. Pigment Violet 19 (MG-1) has the largest value of $\sqrt{\{(a^*)^2+(b^*)^2\}}$, compared to MT-2 to MT-4, which indicates that the color gamut is wide. Further, the magenta toner of MT-5 in which the amount of C.I. Pigment Violet 19 added in MT-1 is decreased from 8 parts by weight to 4 parts by weight is lowered in the value of $\sqrt{\{(a^*)^2+(b^*)^2\}}$ to the same level as MT-4. It is therefore preferred that the addition amount of C.I. Pigment Violet 19 is at least more than 4 parts by weight.

Further, calculation of the color difference (ΔE) between each magenta toner and the magenta toner of Reference Example indicates that MT-1 is smallest in ΔE, and close to the magenta toner of the heat roll fixing system. As for the smearing property, all magenta toners had no problem.

Accordingly, MT-1, i.e., the magenta toner containing the coloring agent of C.I. Pigment Violet 19 can compensate for the influence of the green color of the infrared ray absorbent, so that the magenta toner which is good in color reproducibility and wide in the color reproduction range can be obtained.

In Table 5, a preferred toner can be confirmed for the cyan toners. CT-1 and CT-2 are large in the value of $\sqrt{\{(a^*)^2+(b^*)^2\}}$, compared to CT-1, which indicates that the color gamut is wide. Further, calculation of the color difference (ΔE) between each cyan toner and the cyan toner of Reference Example indicates that CT-1 is small in ΔE, compared to CT-2 and CT-3.

Further, in the evaluation of the smearing property, CT-4 and CT-5 were also evaluated in which the amount of the coloring agent added in CT-1 was increased. CT-4 had no problem, but CT-5 in which the amount of the coloring agent added was increased to 7 parts by weight was much smeared, resulting in the poor smearing property.

Accordingly, the results of the evaluations of the color reproducibility and the smearing property reveal that CT-1 and CT-2, i.e., the cyan toners containing the coloring agent of α-copper phthalocyanine, are most preferred, and that the amount of α-copper phthalocyanine added is preferably 5 parts by weight or less based on 100 parts by weight of the toner.

The fixing test was conducted for combinations of the yellow toners, the magenta toners and the cyan toners. The combinations are as shown below, which include combinations (color toner set) of Examples 1 and 2 according to the invention and combinations (color toner set) of Comparative Examples 1 to 5 not according to the invention. In the following Examples and Comparative Examples, Y, M and C each represents a yellow toner, a magenta toner and a cyan toner.

Example 1

Y: YT-1, M: MT-1, C: CT-1

Example 2

Y: YT-2, M: MT-1, C: CT-1

Comparative Example 1

Y: YT-1, M: MT-3, C: CT-2

Comparative Example 2

Y: YT-2, M: MT-4, C: CT-2

Comparative Example 3

Y: YT-1, M: MT-2, C: CT-1

Comparative Example 4

Y: YT-1, M: MT-1, C: CT-3

Comparative Example 5

Y: YT-2, M: MT-5, C: CT-1

REFERENCE EXAMPLE

As Reference Example for Examples and Comparative Examples described above, L*, a* and b* of a fixed image printed using a GL8300 laser printer of the heat roll fixing system (manufactured by Fujitsu Corporation) and a genuine color toner for this laser printer (the same as with Reference Example described above, and further using a black toner) were obtained.

The results of the evaluation of the color reproducibility are shown in Tables 6 and 7, and FIG. 2. Table 6(A) to 6(E) show the results of the evaluation of Examples 1 and 2 and Comparative Examples 1 to 3, Tables 7(F) and 7(G) show the results of Comparative Examples 4 and 5, respectively, and Table 7(H) shows the results of Reference Example and further, Table 7(I) shows color values of Japan Color (the third edition).

Results of Evaluation of Color Reproducibility (1)

TABLE 6(A)

| | Example 1 | | | |
|---|---|---|---|---|
| | L* | a* | b* | $\{(a^*)^2 + (b^*)^2\}^{1/2}$ |
| Y | 85.53 | −10.25 | 75.35 | 76.04 |
| R | 49.53 | 51.14 | 38.32 | 63.90 |
| M | 51.85 | 55.80 | 3.21 | 55.89 |
| B | 32.82 | 11.39 | −23.74 | 26.33 |
| C | 49.81 | 14.2 | −35.2 | 37.96 |
| G | 46.2 | −49.02 | 11.08 | 50.26 |
| Y | 85.53 | −10.25 | 75.35 | 76.04 |

TABLE 6(B)

| | Example 1 | | | |
|---|---|---|---|---|
| | L* | a* | b* | $\{(a^*)^2 + (b^*)^2\}^{1/2}$ |
| Y | 85.29 | −12.20 | 70.60 | 71.65 |
| R | 48.6 | 49.3 | 36.9 | 61.58 |
| M | 51.85 | 55.80 | 3.21 | 55.89 |
| B | 32.82 | 11.39 | −23.74 | 26.33 |
| C | 49.81 | −14.2 | −35.2 | 37.96 |
| G | 47.2 | −46.8 | 10.6 | 47.99 |
| Y | 85.29 | −12.20 | 70.60 | 71.65 |

TABLE 6(C)

| | Comparative Example 1 | | | |
|---|---|---|---|---|
| | L* | a* | b* | $\{(a^*)^2 + (b^*)^2\}^{1/2}$ |
| Y | 85.53 | −10.25 | 75.35 | 76.04 |
| R | 48.6 | 35.6 | 32.6 | 48.27 |
| M | 45.96 | 43.26 | 3.20 | 43.38 |
| B | 31.2 | 6.32 | −18.23 | 19.29 |
| C | 46.3 | −27.6 | −30.5 | 41.13 |
| G | 46.3 | −56.9 | 14.2 | 58.65 |
| Y | 85.53 | −10.25 | 75.35 | 76.04 |

TABLE 6(D)

| | Comparative Example 2 | | | |
|---|---|---|---|---|
| | L* | a* | b* | $\{(a^*)^2 + (b^*)^2\}^{1/2}$ |
| Y | 85.29 | −10.20 | 70.60 | 71.65 |
| R | 47.6 | 34.2 | 30.6 | 45.89 |
| M | 45.96 | 44.23 | −2.60 | 44.31 |
| B | 32.3 | 6.32 | −22.3 | 23.18 |
| C | 48.3 | −27.6 | −30.5 | 41.13 |
| G | 46.3 | −56.9 | 14.2 | 58.65 |
| Y | 85.29 | −12.20 | 70.60 | 71.65 |

TABLE 6(E)

| | Comparative Example 3 | | | |
|---|---|---|---|---|
| | L* | a* | b* | $\{(a^*)^2 + (b^*)^2\}^{1/2}$ |
| Y | 85.53 | −10.25 | 75.35 | 76.04 |
| R | 50.3 | 38.2 | 30.6 | 48.94 |
| M | 51.85 | 50.60 | −8.20 | 51.26 |

TABLE 6(E)-continued

| | Comparative Example 3 | | | |
|---|---|---|---|---|
| | L* | a* | b* | $\{(a^*)^2 + (b^*)^2\}^{1/2}$ |
| B | 32.6 | 12.3 | −27.3 | 29.94 |
| C | 49.81 | −14.2 | −35.2 | 37.96 |
| G | 46.2 | −49.02 | 11.08 | 50.26 |
| Y | 85.53 | −10.25 | 75.35 | 76.04 |

Results of Evaluation of Color Reproducibility (2)

TABLE 7(F)

| | Comparative Example 4 | | | |
|---|---|---|---|---|
| | L* | a* | b* | $\{(a^*)^2 + (b^*)^2\}^{1/2}$ |
| Y | 85.53 | −10.25 | 75.35 | 76.04 |
| R | 49.53 | 51.14 | 38.32 | 63.90 |
| M | 51.85 | 55.80 | 3.21 | 55.89 |
| B | 33.2 | 12.6 | −20.3 | 23.89 |
| C | 48.26 | −10.2 | −26.3 | 28.21 |
| G | 45.3 | −42.3 | 15.3 | 44.98 |
| Y | 85.53 | −10.25 | 75.35 | 76.04 |

TABLE 7(G)

| | Comparative Example 5 | | | |
|---|---|---|---|---|
| | L* | a* | b* | $\{(a^*)^2 + (b^*)^2\}^{1/2}$ |
| Y | 85.29 | −12.20 | 70.60 | 71.65 |
| R | 48.60 | 40.30 | 32.30 | 61.65 |
| M | 55.12 | 46.20 | 3.10 | 46.30 |
| B | 32.82 | 10.25 | −18.60 | 21.24 |
| C | 49.81 | −14.20 | −35.20 | 37.96 |
| G | 47.20 | −46.80 | 10.60 | 47.99 |
| Y | 85.29 | −12.20 | 70.60 | 71.65 |

TABLE 7(H)

| | Reference Example | | | |
|---|---|---|---|---|
| | L* | a* | b* | $\{(a^*)^2 + (b^*)^2\}^{1/2}$ |
| Y | 90.9 | −11.3 | 79.3 | 80.10 |
| R | 50.4 | 55.5 | 32.4 | 64.27 |
| M | 55.2 | 63.5 | −2.6 | 63.55 |
| B | 33.2 | 16.5 | −35.3 | 38.97 |
| C | 58.5 | −17.6 | −47.5 | 50.66 |
| G | 49.3 | −50.3 | 11.3 | 51.55 |
| Y | 90.9 | −11.3 | 79.3 | 80.10 |

TABLE 7(I)

| | Japan Color | | | |
|---|---|---|---|---|
| | L* | a* | b* | $\{(a^*)^2 + (b^*)^2\}^{1/2}$ |
| Y | 86.5 | −6.6 | 91.1 | 91.34 |
| R | 48 | 65.5 | 48 | 81.20 |
| M | 46.3 | 74.4 | −4.8 | 74.55 |
| B | 23.1 | 20.4 | −52.1 | 55.95 |
| C | 53.9 | −35.9 | −50.4 | 61.88 |
| G | 48.9 | −70.1 | 27.1 | 75.16 |
| Y | 86.5 | −6.6 | 91.1 | 91.34 |

Figure 2A:
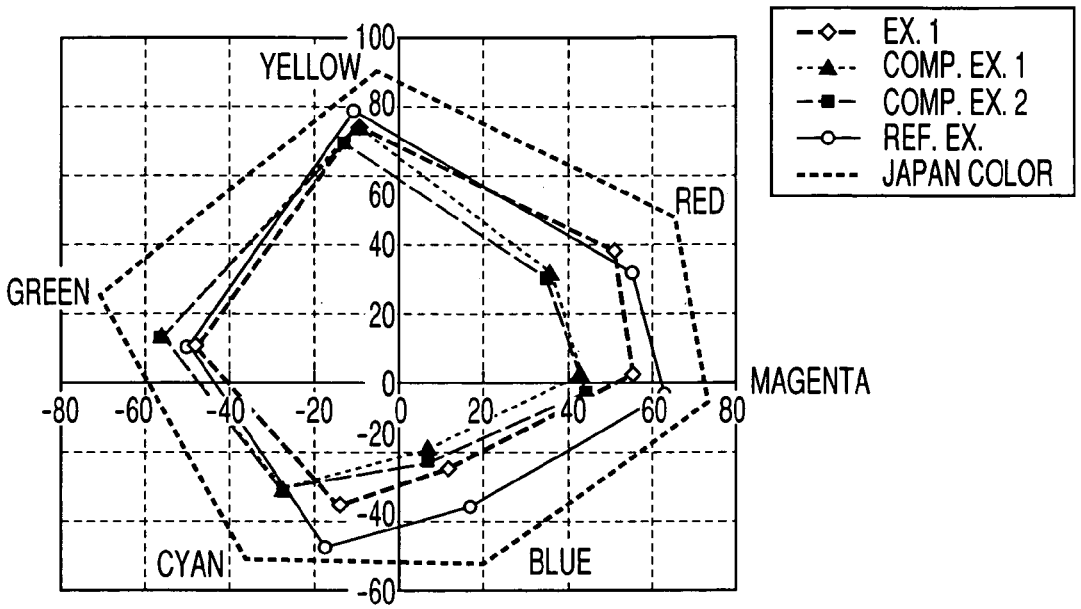
FIGS. 2A and 2B are chromaticity diagrams showing results indicated in Tables 6 and 7.
Figure 2B:
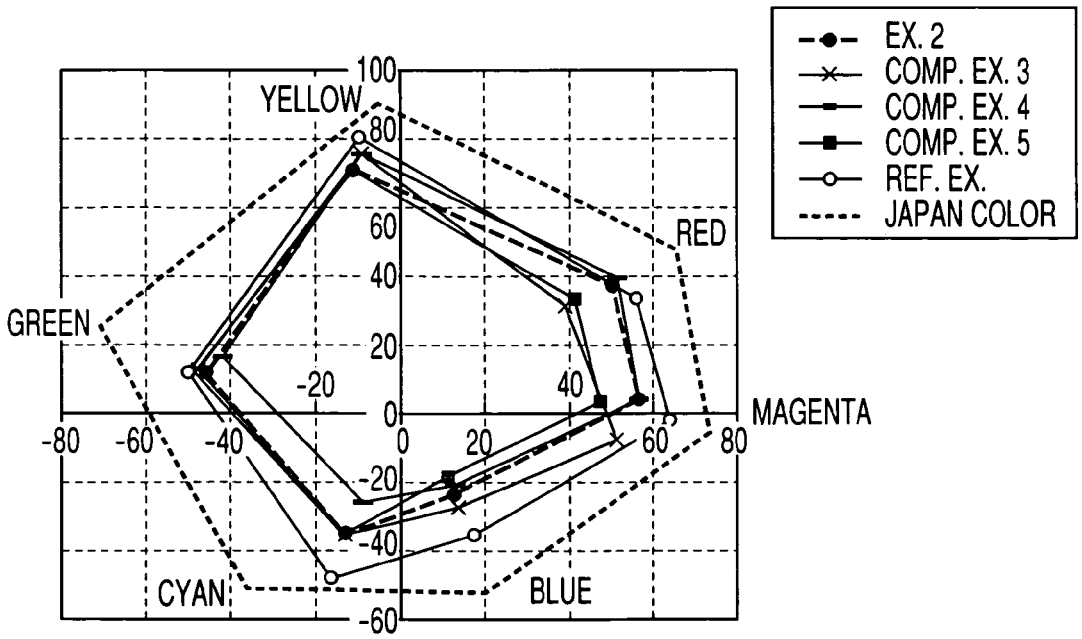

FIGS. 2A and 2B are chromaticity diagrams showing the results indicated in Tables 6 and 7.

In FIGS. 2A and 2B, the ordinate indicates a*, and the abscissa indicates b*. The space represented by the coordinates of L*, a* and b* is a uniform color space determined so that a definite distance between two colors indicated on the coordinates corresponds to a defined perceptual color difference in any color region. Accordingly, also in these chromaticity diagrams represented by a* and b*, it is better that the two colors are closer to each other. A color toner set having color values close to the values of the fixed image of the heat roll fixing system shown as Reference Example is preferred.

The reference to FIGS. 2A and 2B shows that, of Examples and Comparative Examples shown herein, Example 1 gives the widest color reproducibility, and indicates values closest to those of Reference Example. Further, Example 2 in which the yellow toner has been replaced from YT-1 to YT-2 in Example 1 is poor in cyan-blue-magenta regions, compared to Reference Example, but does not largely change in a hue angle. Accordingly, a visually good full-color image can be obtained. Furthermore, in both Examples 1 and 2, it is seen that the color gamut is widened in the regions of magenta and red.

Further, in Comparative Example 1 (the magenta toner has been replaced from MT-1 to MT-2, and the cyan toner has been replaced from CT-1 to CT-2, in Example 1) and Comparative Example 2 (the magenta toner has been replaced from MT-1 to MT-4, and the cyan toner has been replaced from CT-1 to CT-2, in Example 2), which are considered to be good combinations for the color toners of the heat roll fixing system, the color gamut shifts to the green color side, resulting in failure to obtain a good magenta or red color. This is caused by the green color of the infrared ray absorbent. In general, the red color is most frequently used, so that it is fatal that the red color can not be printed well. In such a combination, the color gamut becomes narrow also with respect to a blue color.

Furthermore, in Comparative Example 3 (the magenta toner has been replaced from MT-1 to MT-2 in Example 1), it is seen that the magenta color deviates to a blue color. Accordingly, a good red color can not be obtained. In Comparative Example 4 (the cyan toner has been replaced from CT-1 to CT-3 in Example 1), the color gamut of the cyan color is decreased when the coloring agent of the cyan toner is changed to α type copper phthalocyanine (C.I. Pigment Blue 15:6) of CG-3. The α type copper phthalocyanine is strongly tinged with red to cause the color reproducibility of a green color to be deteriorated, resulting in impairment of the balance of the whole colors.

Further, in Comparative Example 5 (the magenta toner has been replaced from MT-1 to MT-5 containing the coloring agent of MT-1 in an amount decreased from 8 parts by weight to 4 parts by weight), the coloring agent of the magenta toner is decreased from 8 parts by weight to 4 parts by weight. As a result, red-magenta-blue color regions become narrow.

From the above, the color toners of Examples 1 and 2 are good in the whole color reproducibility and provide wide color reproducibility. Further, they come closer to the color reproducibility of the color toner of the heat roll fixing system, so that it is possible to use the same color matching system as used in the color toner of the heat roll fixing system.

Fixing Test of Color Toner and Evaluation of Fixability

Then, the fixability was studied.

As for YT-1 which is the above-mentioned yellow toner, the fixability was optimized using binder resins having various number average molecular weights. Materials of the binder resins used in this evaluation are shown in Table 8. Specifically, polyester S0 contained in the composition of YT-1 shown in Table 4 was replaced by polyesters S1 to S5 shown together with polyester S0 in Table 8. The amount thereof added was 5 parts by weight based on 100 parts by weight of the toner. A manufacturing method of this yellow toner and an image forming method were the same as described above.

TABLE 8

Materials for Binder resins Used in Evaluation of Fixability

| Sample Name | Mn | Mw | Mw/Mn |
|---|---|---|---|
| S0 | 1526 | 9980 | 6.5 |
| S1 | 1156 | 7756 | 6.7 |
| S2 | 789 | 5963 | 7.6 |
| S3 | 2389 | 15263 | 6.4 |
| S4 | 2980 | 21500 | 7.2 |
| S5 | 4800 | 34960 | 7.3 |

The fixability was evaluated by a tape peel test. The tape peel test is a teat method of lightly adhering an adhesive tape (Scotch Mending Tape manufactured by 3M Corp.) onto a fixed image, closely adhering the tape thereto by rolling a cylindrical block having a diameter of 50 mm and a width of 30 mm in its circumferential direction over the tape, while applying a load of 500 gf to the cylindrical block, and then, peeling off the tape. The fixing rate is expressed by "fixing rate=(optical density of fixed image after peeling of tape/optical density of fixed image before peeling of tape)×100". The optical density of the fixed image was evaluated by measuring reflective light at 400 nm using a color difference meter, a 938 spectrodensitometer (measurement light source: CIE-D65) manufactured by X-Rite, Inc., and taking the resulting absorbance value as the optical density.

Figure 3:
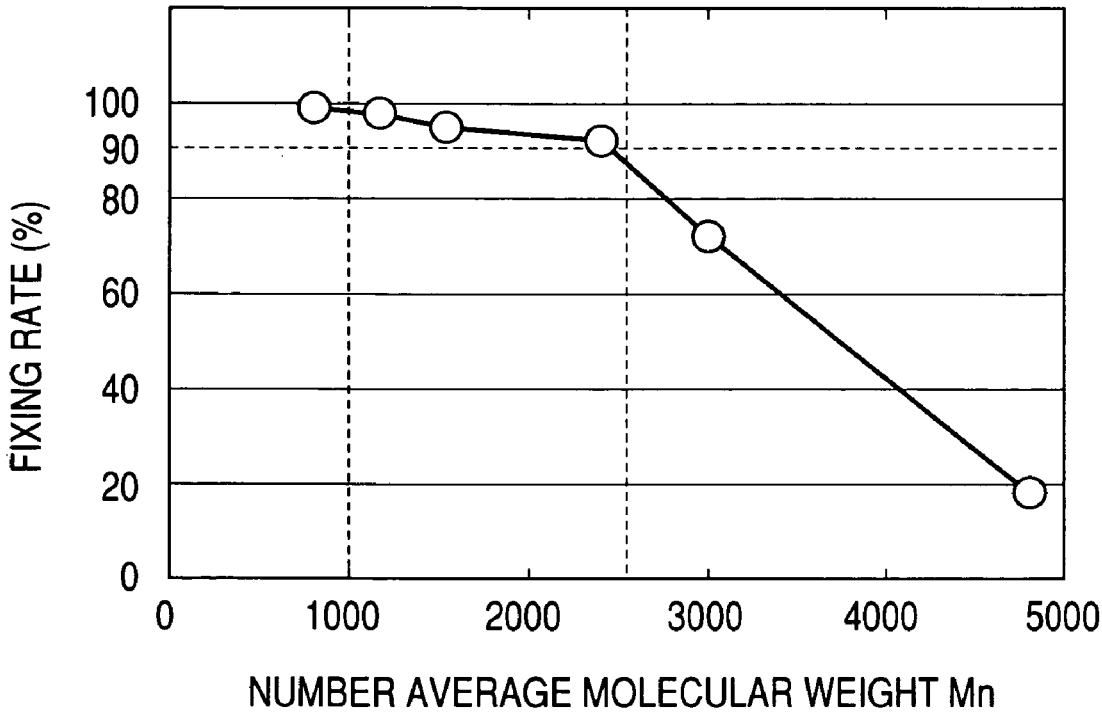
FIG. 3 is a graph showing the relationship between the fixing rate and the number average molecular weight of a binder resin.

The results of the above evaluation are shown in FIG. 3. FIG. 3 is a graph showing the relationship between the fixing rate and the number average molecular weight Mn of the binder resin. The reference to FIG. 3 shows that the fixing rate of the color toner having a number average molecular weight Mn of 2,500 or less is 90% or more, and the fixability is good in this range. However, in the color toner having a number average molecular weight Mn of less than 1,000, the binder resin sublimed in fresh fixing, which caused a flue gas filter of a laser printer used in the fixing test to be clogged. It is therefore preferred that the binder has a number average molecular weight Mn of 1,000 to 2,500. Further, the number average molecular weight Mn is more preferably from 1,000 to 1,500. The use of the binder resin within this number average molecular weight Mn range provided similarly good color reproducibility and similar fixability, even when the infrared ray absorbent was replaced from a naphthalocyanine family to an aminium salt (for example, AM1 (trade name, manufactured by Teikoku Chemical Industries Co., Ltd.)) or a diimonium family (for example, IRG003 (trade name, manufactured by Nippon Kayaku Co., Ltd)).

The color image forming apparatus, an embodiment of the invention, will be briefly illustrated below.

Figure 4:
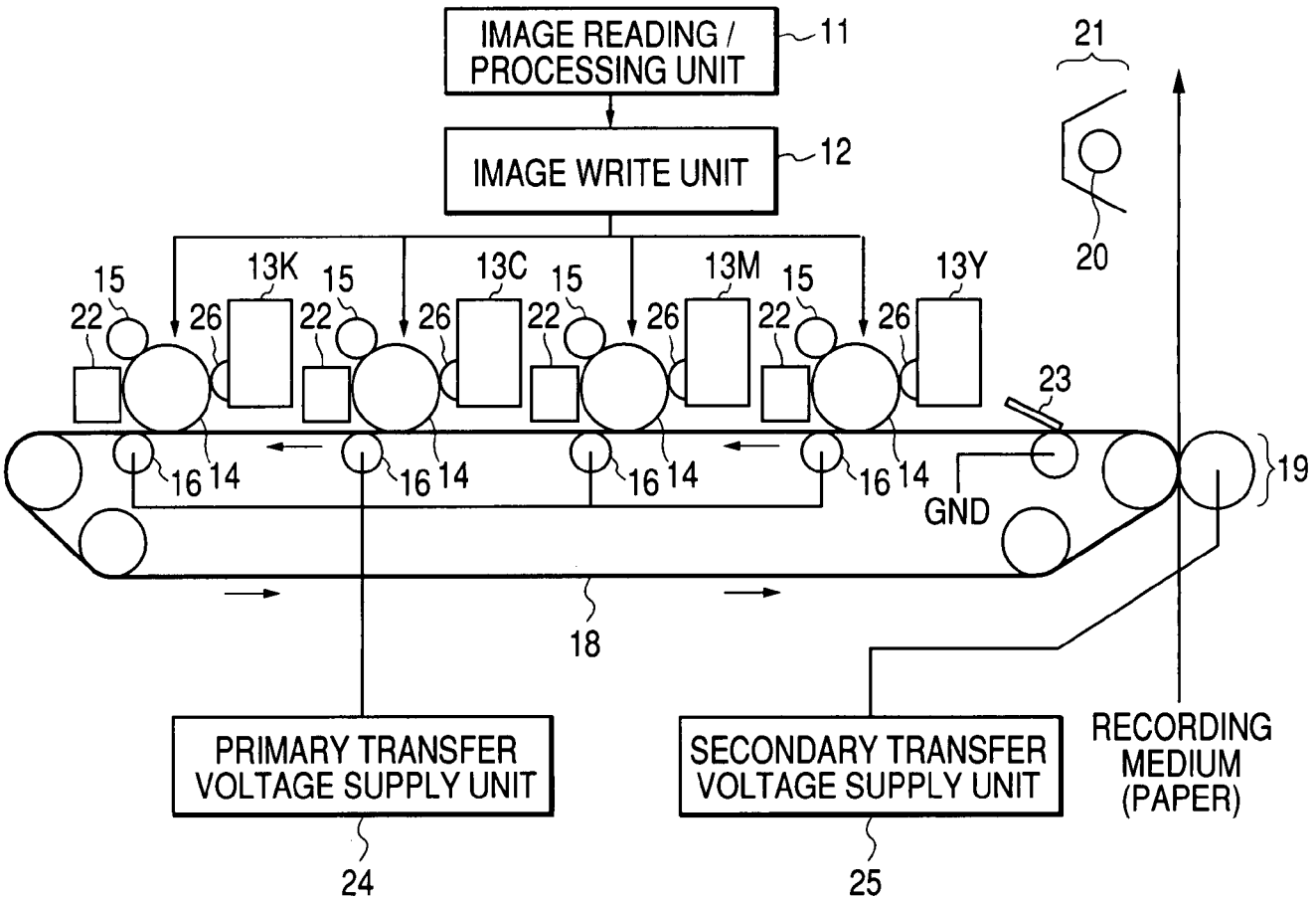
FIG. 4 is a view schematically showing an embodiment of the color image forming apparatus according to the invention.

FIG. 4 is a view schematically showing a color image forming apparatus, an embodiment of the invention. This apparatus 10 comprises an image reading/processing unit 11, an image write unit 12, developing units 13Y, 13M, 13C and 13K provided for the respective colors of yellow, magenta, cyan and black, a photoreceptor 14, a charging device 15, a primary transfer unit 16, an intermediate transfer body 18, a secondary transfer unit 19, a flash fixing device 21 having a xenon flash lamp 20, a photoreceptor cleaning unit 22, an intermediate transfer body cleaning unit 23, a primary transfer voltage supply unit 24, a secondary transfer voltage supply unit 25, etc. This apparatus forms a full-color image on a recording medium using four colors of yellow, magenta, cyan and black.

The developing units 13Y, 13M, 13C and 13K each contains a developing agent container not shown and a developing roller 26, and a monocomponent developing agent comprising the color toner of the invention is contained in the developing agent container. Further, an electrostatic latent image is written on the photoreceptor 14 with the image write unit 12, and the color toner is supplied from the developing roller 26. Thus, the color toner adheres to the photoreceptor 14 corresponding to the electrostatic latent image. As the photoreceptor 14, there can be generally used an inorganic photoreceptor such as amorphous silicon or selenium, or an organic photoreceptor such as polysilane or phthalocyanine. In particular, amorphous silicon is preferred in terms of long life.

A toner image formed on the photoreceptor is transferred to the intermediate transfer body 18 at the primary transfer unit 16. The toner image formed by transferring the four colors of yellow, magenta, cyan and black in this order is transferred to the recording medium at the secondary transfer unit 19, and the recording medium is conveyed to the fixing device 21.

The fixing device 21 conducts fixing by the flash fixing system using, for example, the xenon flash lamp 20. In the fixing, for example, a flash light of the xenon flash lamp 20 is once irradiated. The energy of the flash light in that case is set to 2 to 7 J/cm$^2$ on the recording medium. The fixing may be conducted for every transfer of each color to the recording medium. In that case, the energy of the flash light is set to 1 to 3 J/cm$^2$ on the recording medium for every fixing. When the energy is less than this range, the toner is not fused, resulting in poor fixing. Conversely, when the energy is too high, voids of the toner or burnt deposits of the recording medium become liable to occur. When the xenon flash lamp is used, the irradiation energy per unit area for every one flash light is expressed by $S=\{(1/2)CV^2/ul/nf\}$, wherein C is the capacitance of capacitor (μF), V is the input voltage (V), u is the conveying speed (mm/s) of the recording medium, l is the print width (mm), n is the number of lamps, and f is the lighting frequency (Hz) of the flash lamp.

According to such an image forming apparatus, it is possible to form an image good in the whole color reproducibility and wide in the color reproduction range, and it is also possible to speed up the printing speed, compared to conventional image forming apparatus of the monocomponent developing system.

In the above-mentioned color image forming apparatus 10, the four colors are first transferred, and then fixed to form the full-color image. However, using four image forming apparatus in which one color is transferred and fixed, the four colors of yellow, magenta, cyan and black may each independently be transferred and fixed to form a full-color image. According to such constitution, the full-color image can be easily formed on the recording medium only by sending the image information of each of the four colors to the corresponding image forming apparatus. Compared to the image forming apparatus shown in FIG. 4 in which the four colors are concurrently fixed, such constitution can reduce equipment cost.

Further, it is not indispensable to use all these four colors. That is to say, the image forming apparatus may be an apparatus which forms an image without using any one of these four colors depending on the kind of printed matter or the color of an image to be formed.

While the present invention has been described in detail and with reference to specific embodiments thereof, it will be apparent to one skilled in the art that various changes and modifications can be made therein without departing from the spirit and scope thereof.

In relation to the above description, additional disclosures are given below.

EMBODIMENT 1

A color toner to be fixed on a recording medium with a flash light comprising a binder resin, an infrared ray absorbent and a coloring agent for mainly developing a yellow color, wherein the coloring agent is C.I. Pigment Yellow 180 or C.I. Pigment Yellow 185.

EMBODIMENT 2

A color toner to be fixed on a recording medium with a flash light comprising a binder resin, an infrared ray absorbent and a coloring agent for mainly developing a magenta color, wherein the coloring agent is C.I. Pigment Violet 19.

EMBODIMENT 3

A color toner to be fixed on a recording medium with a flash light comprising a binder resin, an infrared ray absorbent and a coloring agent for mainly developing a cyan color, wherein the coloring agent is C.I. Pigment Blue 15.

EMBODIMENT 4

The color toner described in any one of Embodiments 1 to 3, wherein the toner contains the coloring agent in an amount of 0.1 to 20 parts by weight based on 100 parts by weight of the toner.

EMBODIMENT 5

The color toner described in Embodiment 2, wherein the toner contains C.I. Pigment Violet 19 in an amount of more than 4 to 20 parts by weight based on 100 parts by weight of the toner.

EMBODIMENT 6

The color toner described in Embodiment 3, wherein the toner contains C.I. Pigment Blue 15 in an amount of 5 parts by weight or less based on 100 parts by weight of the toner.

EMBODIMENT 7

The color toner described in any one of Embodiments 1 to 6, wherein the infrared ray absorbent comprises a naphthalocyanine compound represented by the following general formula (1):

(1)

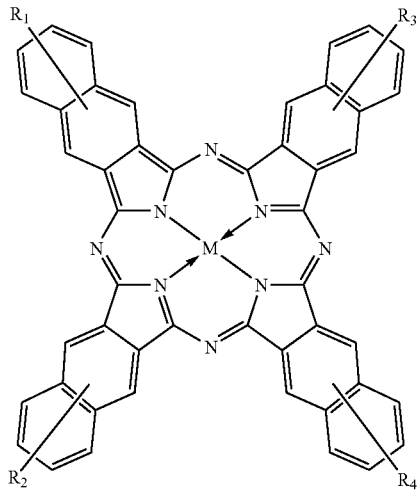

wherein M represents a metal, a metal oxide or a metal halide, R1 to R4 each represents a hydrogen atom, a halogen atom, an alkyl group, an aryl group, an alkoxyl group, a nitro group or a carboxyl group.

EMBODIMENT 8

The color toner described in any one of Embodiments 1 to 7, wherein the infrared ray absorbent is surface treated with a coupling agent.

EMBODIMENT 9

The color toner described in any one of Embodiments 1 to 8, wherein the binder resin has a number average molecular weight of 1,000 to 2,500.

EMBODIMENT 10

The color toner described in any one of Embodiments 1 to 9, wherein the toner further comprises a fluidity improving agent in an amount of 0.01 to 5 parts by weight based on 100 parts by weight of the toner.

EMBODIMENT 11

A color toner set for forming a multi-color image through fixing on a recording medium with a flash light, which comprises at least a yellow toner, a magenta toner and a cyan toner, wherein each toner comprises a binder resin, an infrared ray absorbent and a coloring agent, and wherein the coloring agent of the yellow toner comprises C.I. Pigment Yellow 180 or C.I. Pigment Yellow 185, the coloring agent of the magenta toner comprises C.I. Pigment Violet 19, and the coloring agent of the cyan toner comprises C.I. Pigment Blue 15.

EMBODIMENT 12

The color toner set described in Embodiment 11, wherein each toner contains the coloring agent in an amount of 0.1 to 20 parts by weight based on 100 parts by weight of the respective toner.

EMBODIMENT 13

The color toner set described in Embodiment 11 or 12, wherein the amounts of the coloring agents contained in the color toners satisfy the following relationship:

$$Qm>Qy>Qc$$

wherein Qm, Qy and Qc represent the amounts of the coloring agents contained in the magenta, yellow and cyan toners, respectively, each based on 100 parts by weight of the respective color toner.

EMBODIMENT 14

The color toner set described in any one of Embodiments 11 to 13, wherein the magenta toner contains C.I. Pigment Violet 19 in an amount of more than 4 to 20 parts by weight based on 100 parts by weight of the magenta toner.

EMBODIMENT 15

The color toner set described in any one of Embodiments 11 to 14, wherein the cyan toner contains C.I. Pigment Blue 15 in an amount of 5 parts by weight or less based on 100 parts by weight of the cyan toner.

EMBODIMENT 16

The color toner set described in any one of Embodiments 11 to 15, wherein the infrared ray absorbent comprises a naphthalocyanine compound represented by the following general formula (1):

(1)

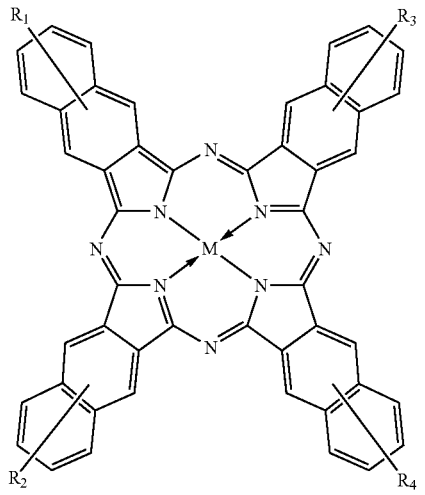

wherein M represents a metal, a metal oxide or a metal halide, R1 to R4 each represents a hydrogen atom, a halogen atom, an alkyl group, an aryl group, an alkoxyl group, a nitro group or a carboxyl group.

EMBODIMENT 17

The color toner set described in any one of Embodiments 11 to 16, wherein the infrared ray absorbent is surface treated with a coupling agent.

EMBODIMENT 18

The color toner set described in any one of Embodiments 11 to 17, wherein the binder resin has a number average molecular weight of 1,000 to 2,500.

EMBODIMENT 19

The color toner set described in any one of Embodiments 11 to 18, wherein each toner comprises a fluidity improving agent in an amount of 0.01 to 5 parts by weight based on 100 parts by weight of the respective toner.

EMBODIMENT 20

An image forming apparatus for superposing at least a yellow toner, a magenta toner and a cyan toner one on another to form a multi-color image and fixing the toners on a recording medium with a flash light, which apparatus employs a color toner or color toner set described in any one of Embodiments 1 to 19.

EMBODIMENT 21

An image forming apparatus for forming an image using a color toner or color toner set described in any one of Embodiments 1 to 19, and fixing the image on a recording medium with a flash light.

As apparent from the above detailed description, according to the invention, there can be provided the color toner for flash fixing which is good in the whole color reproducibility and wide in the color reproduction range, and the image forming apparatus using the same.

What is claimed is:

1. A color toner to be fixed on a recording medium with a flash light, comprising a binder resin, an infrared ray absorbent and a coloring agent for mainly developing a yellow color, wherein the coloring agent is a C.I. Pigment Yellow 180 of the formula

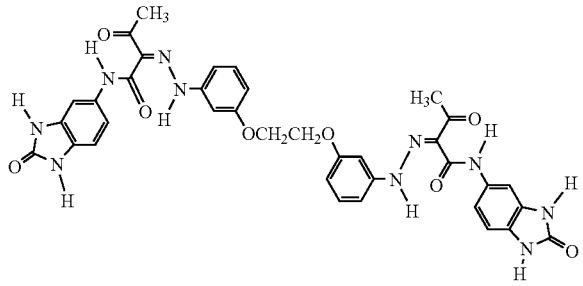

or a C.I. Pigment Yellow 185 of the formula

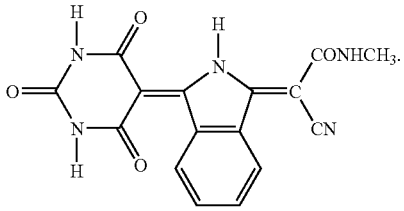

2. The color toner according to claim 1, wherein the infrared ray absorbent comprises a naphthalocyanine compound represented by the following general formula (1):

(1)

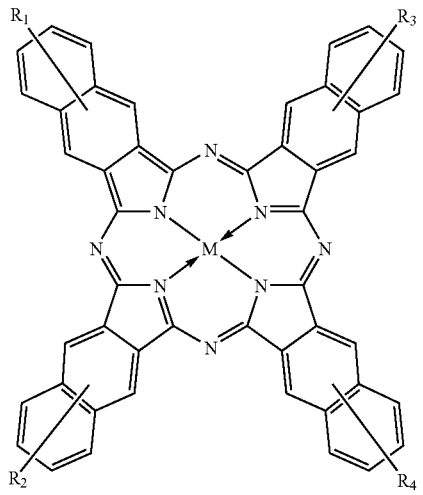

wherein M represents a metal, a metal oxide or a metal halide, R1 to R4 each represents a hydrogen atom, a halogen atom, an alkyl group, an aryl group, an alkoxyl group, a nitro group or a carboxyl group.

3. The color toner according to claim 1, wherein the binder resin has a number average molecular weight of 1,000 to 2,500.

4. An image forming apparatus for superposing at least a yellow toner, a magenta toner and a cyan toner one on another to form a multi-color image and fixing the toners on a recording medium with a flash light, which apparatus employs a color toner according to claim 1.

5. A color toner to be fixed on a recording medium with a flash light, comprising a binder resin, an infrared ray absorbent and a coloring agent for mainly developing a magenta color, wherein the coloring agent is a C.I. Pigment Violet 19

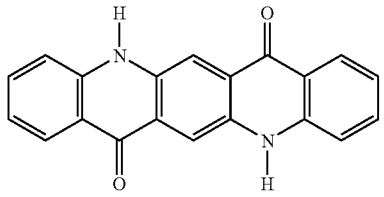

6. The color toner according to claim 5, wherein the toner contains the C.I. Pigment Violet 19 in an amount of more than 4 to 20 parts by weight based on 100 parts by weight of the toner.

7. An image forming apparatus for superposing at least a yellow toner, a magenta toner and a cyan toner one on another to form a multi-color image and fixing the toners on a recording medium with a flash light, which apparatus employs a color toner according to claim 5.

8. The color toner according to claim 5, wherein the infrared ray absorbent comprises a naphthalocyanine compound represented by the following general formula (1):

(1)

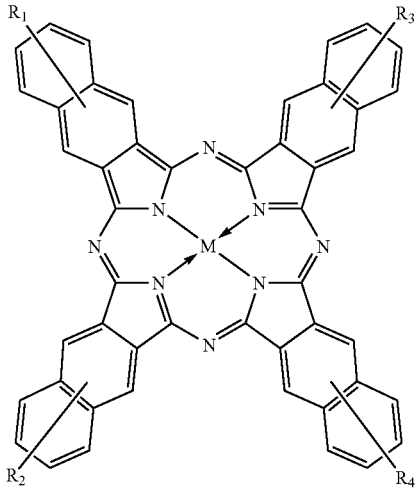

wherein M represents a metal, a metal oxide or a metal halide, R1 to R4 each represents a hydrogen atom, a halogen atom, an alkyl group, an aryl group, an alkoxyl group, a nitro group or a carboxyl group.

9. The color toner according to claim 5, wherein the binder resin has a number average molecular weight of 1,000 to 2,500.

10. A color toner set for forming a multi-color image through fixing on a recording medium with a flash light, which comprises at least a yellow toner, a magenta toner and a cyan toner, wherein each toner comprises a binder resin, an infrared ray absorbent and a coloring agent, and wherein the coloring agent of the yellow toner comprises a C.I. Pigment Yellow 180 of the formula

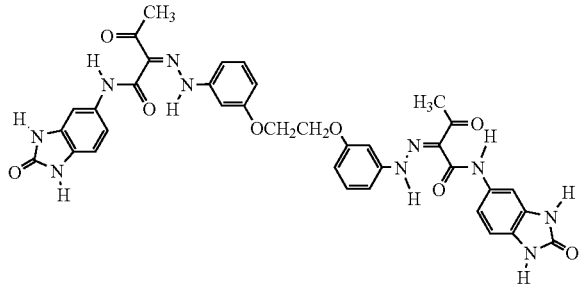

or a C.I. Pigment Yellow 185 of the formula

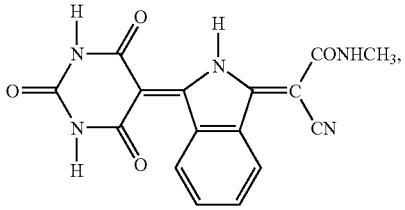

the coloring agent of the magenta toner comprises a C.I. Pigment Violet 19

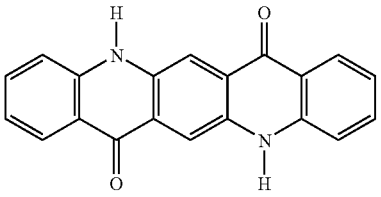

and the coloring agent of the cyan toner comprises a C.I. Pigment Blue 15 of the formula

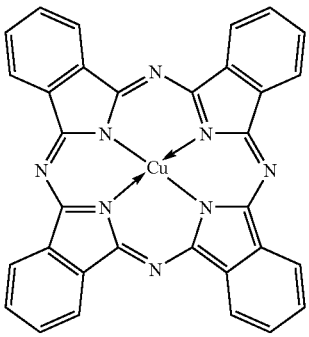

11. The color toner set according to claim 10, wherein the amounts of the coloring agents contained in the color toners satisfy the following relationship:

$$Qm>Qy>Qc$$

wherein Qm, Qy and Qc represent the amounts of the coloring agents contained in the magenta, yellow and cyan toners, respectively, each based on 100 parts by weight of the respective color toner.

12. The color toner set according to claim 10, wherein the magenta toner contains the C.I. Pigment Violet 19 in an amount of more than 4 to 20 parts by weight based on 100 parts by weight of the magenta toner.

13. The color toner set according to claim 10, wherein the cyan toner contains the C.I. Pigment Blue 15 in an amount of 5 parts by weight or less based on 100 parts by weight of the cyan toner.

14. The color toner set according to claim 10, wherein the infrared ray absorbent comprises a naphthalocyanine compound represented by the following general formula (1):

(1)

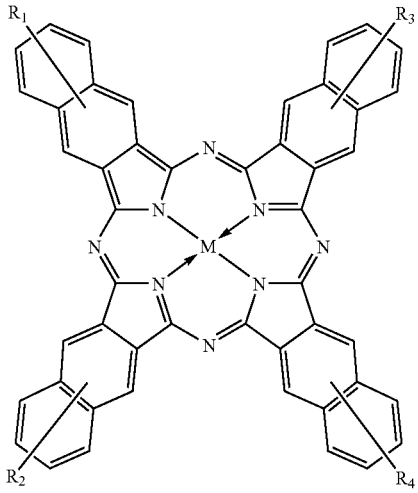

wherein M represents a metal, a metal oxide or a metal halide, R1 to R4 each represents a hydrogen atom, a halogen atom, an alkyl group, an aryl group, an alkoxyl group, a nitro group or a carboxyl group.

15. The color toner set according to claim 10, wherein the binder resin has a number average molecular weight of 1,000 to 2,500.

* * * * *